US007797796B2

(12) United States Patent
Migli

(10) Patent No.: US 7,797,796 B2
(45) Date of Patent: Sep. 21, 2010

(54) ARTICULATED-QUADRILATERAL HINGE ASSEMBLY WITH ADAPTABLE STABILISER BAR FOR VERTICAL-MOVEMENT DOORS

(75) Inventor: Carlo Migli, Lecco LC (IT)

(73) Assignee: Agostino Ferrari S.p.A., Bergamo, BG (IT)

( * ) Notice: Subject to any disclaimer, the term of this patent is extended or adjusted under 35 U.S.C. 154(b) by 480 days.

(21) Appl. No.: 11/984,872

(22) Filed: Nov. 23, 2007

(65) Prior Publication Data

US 2008/0172833 A1 Jul. 24, 2008

(30) Foreign Application Priority Data

Nov. 22, 2006 (IT) ..... MI2006A2235

(51) Int. Cl.
*E05D 3/06* (2006.01)

(52) U.S. Cl. ..... 16/366; 16/286; 16/368

(58) Field of Classification Search ..... 16/366, 16/368–370, 286–289, 306; 49/253, 254, 49/255, 257, 322, 246, 258; 312/322–325, 312/110, 109, 319.1, 319.2, 334.4, 334.5
See application file for complete search history.

(56) References Cited

U.S. PATENT DOCUMENTS 2,781,560 A * 2/1957 Ziesmer ..... 16/329
3,088,727 A * 5/1963 Pelagatti ..... 74/89.18
3,261,051 A * 7/1966 Priest ..... 16/288
6,073,624 A * 6/2000 Laurent ..... 126/334
6,442,799 B1 * 9/2002 Duarte et al. ..... 16/277
6,643,896 B2 * 11/2003 Carrier ..... 16/242
7,178,202 B2 * 2/2007 Hirtsiefer et al. ..... 16/366
7,240,974 B2 * 7/2007 Hirtsiefer ..... 312/109
2001/0039762 A1 * 11/2001 Giovannetti ..... 49/246
2002/0108311 A1 * 8/2002 Salice ..... 49/371

FOREIGN PATENT DOCUMENTS

DE 10203269 A1 * 8/2003
EP 1589174 A2 * 10/2005

* cited by examiner

*Primary Examiner*—Chuck Y. Mah
(74) *Attorney, Agent, or Firm*—Jacobson Holman PLLC

(57) ABSTRACT

A hinge assembly for vertical-movement doors comprises two articulated-quadrilateral hinges each including a first plate designed to be fastened to the furniture flanks, a second plate designed to be fastened to the door and two superposed arms pivotally mounted between the plates to form the quadrilateral connecting-rods. The assembly comprises brackets for removable fastening of the bar ends to the hinges, where the brackets can be alternatively mounted at two different fastening seats present at locations spaced apart from each other, along the upper arm of each hinge.

13 Claims, 4 Drawing Sheets

ARTICULATED-QUADRILATERAL HINGE ASSEMBLY WITH ADAPTABLE STABILISER BAR FOR VERTICAL-MOVEMENT DOORS

BACKGROUND OF THE INVENTION

1. Field of the Invention

The present invention relates to an articulated-quadrilateral hinge assembly for vertical-movement doors, which is provided with a stabilizer bar that is quickly adaptable to different operating requirements.

2. State of the Prior Art

It is known that in articulated-quadrilateral hinge assemblies designed for opening furniture doors in a vertical direction with translation or combined translation-rotation movements, there are two articulated quadrilateral hinges that are disposed on the sides of the hollow space closed by the door and are connected to each other by a transverse bar. This bar is required because the two hinges have such a wide movement that otherwise synchronization of the two kinematic mechanisms would not be allowed. For instance, should the door be opened by pulling it from the right end, in the absence of the bar the right hinge would tend to be the first to open, thus causing an unacceptable side oscillation of the door.

To solve this problem, therefore, a transverse bar is used that is rigidly fastened to two homologous components of the two kinematic mechanisms so as to reduce the possibility of mutual angular displacements to the minimum.

While the exact fastening position of the bar is not of great importance to the ends of the kinematic movement (generally it is sufficient for it to be connected at any point along one of the two connecting-rod arms of the hinges), on the contrary the bar position acquires a great importance if the practical use of the hinge assembly is taken into account. In fact, if positioning of the bar on the upper connecting-rods at a location moved towards the door is considered, easy access to the bar is obtained and at the same time the bar fully moves away from the access opening to the piece of furniture and is not in the way when the door is open.

On the contrary, with such a positioning of the bar, upon closure of the door, the bar greatly moves downwards, i.e. towards the door centre line. While this is of no importance in the case of non transparent doors, if the door is made of transparent or semi-transparent material at least at the centre part thereof, the bar becomes visible through the closed door, which adversely affects the aesthetic appearance of same.

To obviate or reduce this drawback, the bar should be shifted upwards as much as possible; an ideal position from this point of view could be that in which the bar axis is coincident with the pivot axis of the upper connecting-rod to the piece of furniture. In the known art therefore solutions have been proposed in which the bar is located at a position very close to or coincident with the pin of the upper connecting-rod on the piece of furniture.

However, this solution too has a drawback, in that during opening of the door, the bar rotates upon itself but its axis does not move and therefore when the door is open the bar will be at the inside of the access opening to the piece of furniture, so that the access opening is limited and introduction or removal of objects is hindered.

Up to now it was the furniture-maker who chose which type of hinge assembly was in his opinion the most appropriate, i.e. the one offering a larger access opening or the one making the bar less visible through transparent or semitransparent doors (for instance, doors provided with a frame surrounding part of the pane of glass). This however has the disadvantage, among some others, that the furniture-maker is obliged to have two different types of hinge in stock so as to be able to choose the most appropriate, depending on the door to be mounted.

It is a general aim of the present invention to obviate the above mentioned drawbacks by providing an articulated quadrilateral hinge assembly with stabilizer bar that is directly and quickly adaptable to the different requirements.

SUMMARY OF THE INVENTION

In view of the above aim, in accordance with the invention, a hinge assembly for vertical-movement doors has been conceived which comprises two articulated-quadrilateral hinges each including a first plate designed to be fastened to the furniture flanks, a second plate designed to be fastened to the door and two superposed arms pivotally mounted between the plates, a horizontal bar for synchronization of the hinge movement being transversely connected between the two hinges, characterized in that it comprises brackets for removable fastening of the bar ends to the hinges, where the brackets can be alternatively mounted at two different fastening seats present at locations spaced apart from each other, along the upper arm of each hinge.

BRIEF DESCRIPTION OF THE DRAWINGS

For better clarifying the innovative principles of the present invention and the advantages it offers as compared with the known art, a possible embodiment applying said principles will be described hereinafter by way of non-limiting example, with the aid of the accompanying drawings.

In the drawings.

DETAILED DESCRIPTION OF THE INVENTION

Figure 1:
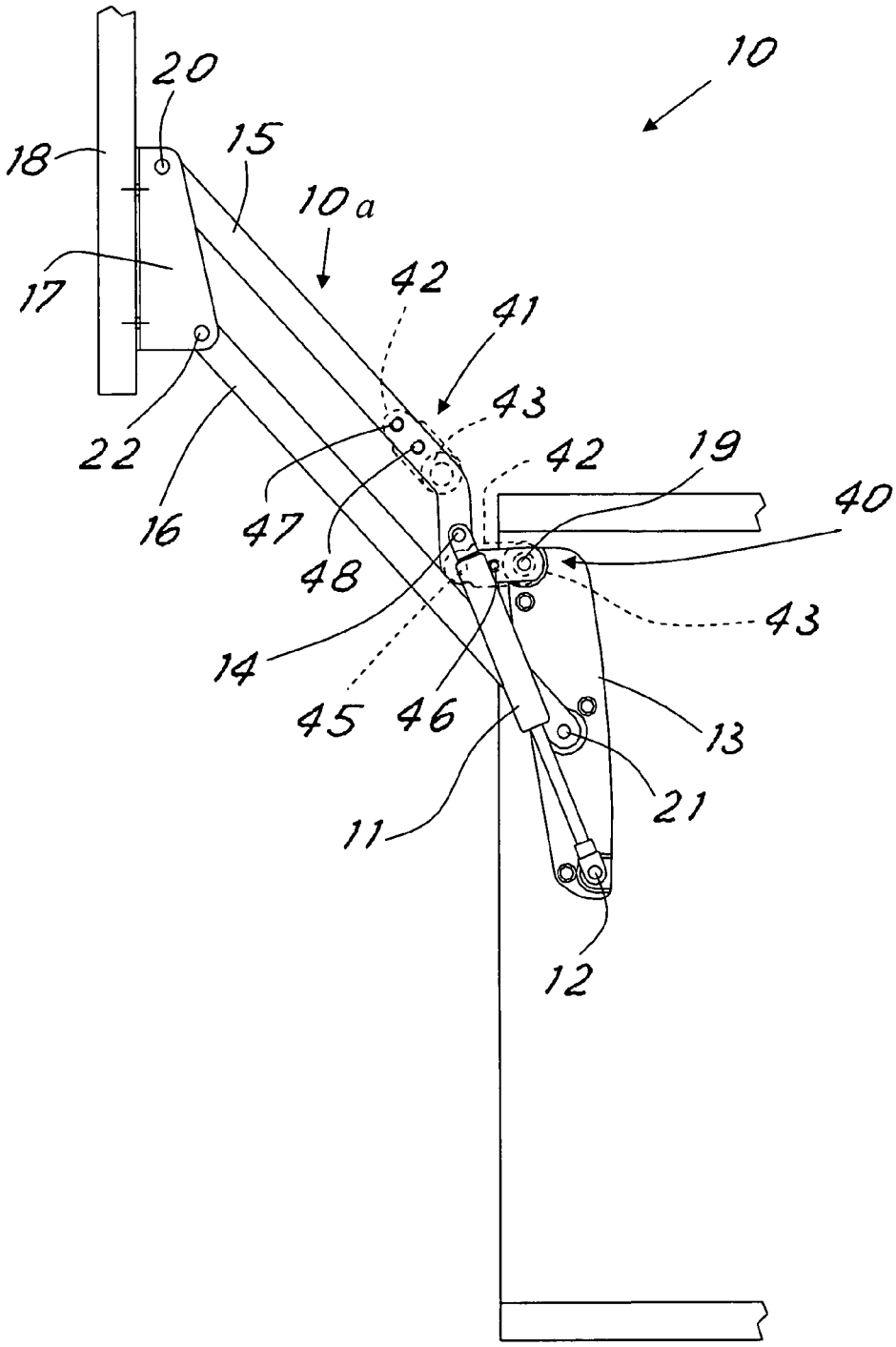
FIG. 1 is a diagrammatic side view of a hinge assembly made in accordance with the invention, in an open position.

With reference to the drawings, shown in FIG. 1 is a hinge assembly for vertical-movement doors, generally denoted at 10. Assembly 10 comprises two articulated-quadrilateral hinges 10*a* and 10*b* in mirror image relationship, to be disposed correspondingly opposite on the two sides of the door (identified with 18 in the figures) to be hinged. For the sake of simplicity, similar elements in the two hinges will be allocated the same reference numerals and only one hinge will be herein described in detail.

Each hinge comprises a first plate 13 designed to be fastened to the furniture side, a second plate 17 designed to be fastened to the door and two superposed arms 15, 16 that are pivotally mounted between the plates at points 19, 20 and 21, 22 so as to form the connecting-rods of the articulated quadrilateral.

The hinges advantageously comprise a movement balancing spring 11 that is connected between the first plate 13 and upper arm 15. The spring is preferably of the piston gas type.

Advantageously, spring 11 is connected to the upper arm 15 at an intermediate position between the hinged extremities 19, 20 of the arm on the plates and is connected to the first plate 13 at a point 12 below the pivot point 21 of the lower arm 16 on the first plate 13. Yet advantageously, the pivot point 14 of spring 11 on the upper arm 15 is offset towards the lower arm 16 relative to the line joining the pivot points 19, 20 of the upper arm 15 to the two plates. Thus better operation of the spring and lower bulkiness to the furniture inside is obtained.

The two hinges each have two seats 40, 41 spaced apart along the upper arm, which can by turns receive the same fastening bracket 42 (drawn in chain line in the two positions in FIG. 1 for the left hinge). Connected to brackets 42 disposed so as to face each other in either seat of both hinges 10*a*, 10*b*, are the ends of a horizontal bar 43 that is thus disposed transverse to the hinges and serves to synchronize the hinge movement. Due to the brackets, removable fastening of the bar ends to the hinges is selectively possible in the two different positions 40, 41, at will.

The first seat 42 is placed close to the pivot point 19 of the upper arm on the first plate 13 to enable the bar to be positioned with its axis substantially coincident with the pivot point axis. In this manner, when the bar is mounted to such a position, it keeps substantially stationary during movement of the hinge between the open and closed positions. In particular, if the bar axis is coincident with the pivot point axis, the bar only rotates upon itself.

Figure 2:
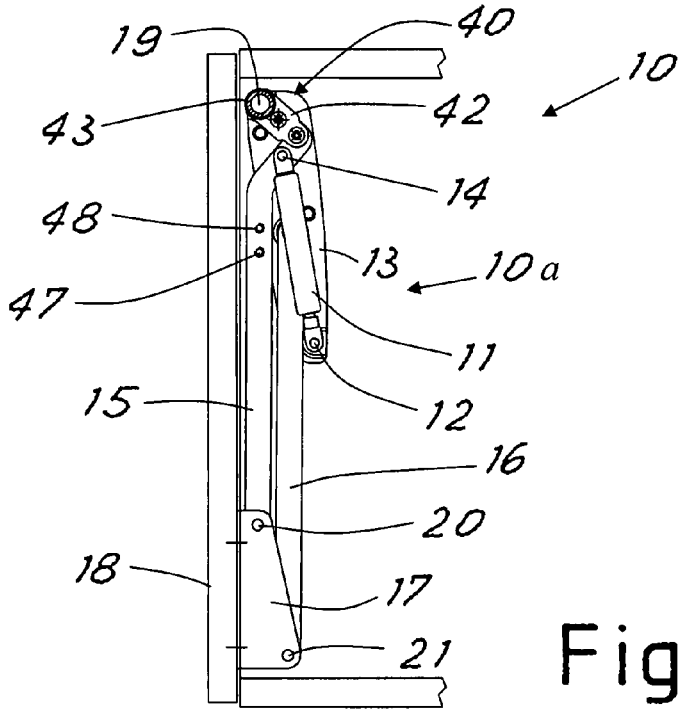
FIG. 2 is a diagrammatic view of the hinge assembly seen in FIG. 1, in a closed position and in a first operating condition.
Figure 3:
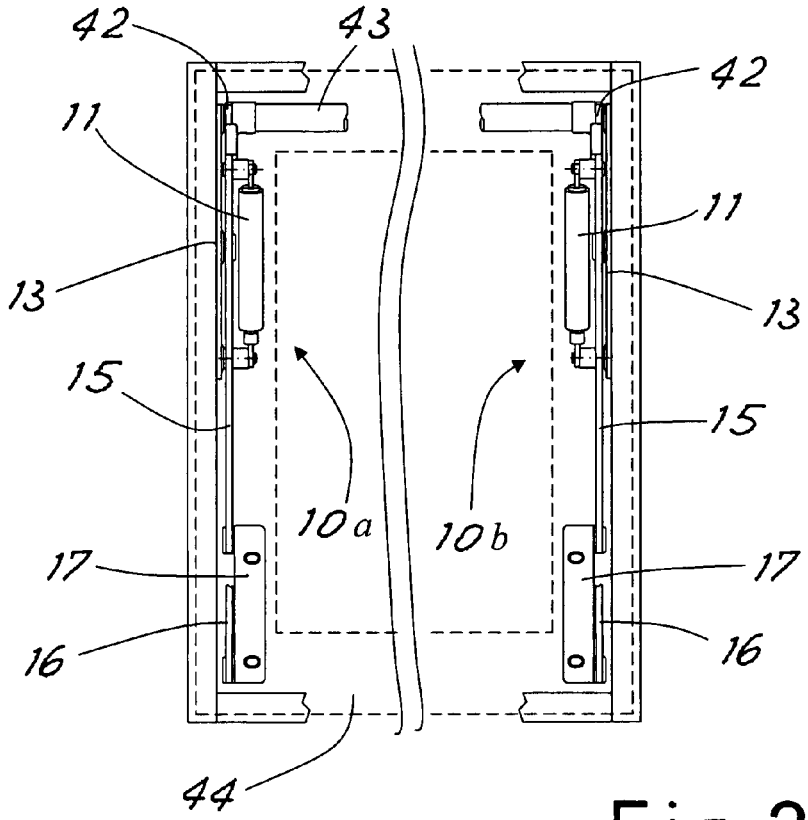
FIG. 3 is a diagrammatic front view of the assembly in the condition shown in FIG. 2.

This is well apparent in FIG. 1 and FIGS. 2 and 3. As clearly shown in FIG. 3, while the bar always keeps within the opening of the hollow space that is closed by the door, the position it maintains is the closest to the upper edge of the hollow space. This position makes the bar less visible in the event of transparent and semitransparent doors. For instance, in this position the bar can be easily concealed behind a border frame 44 of door 18 having a central transparent or semitransparent pane.

Figure 4:
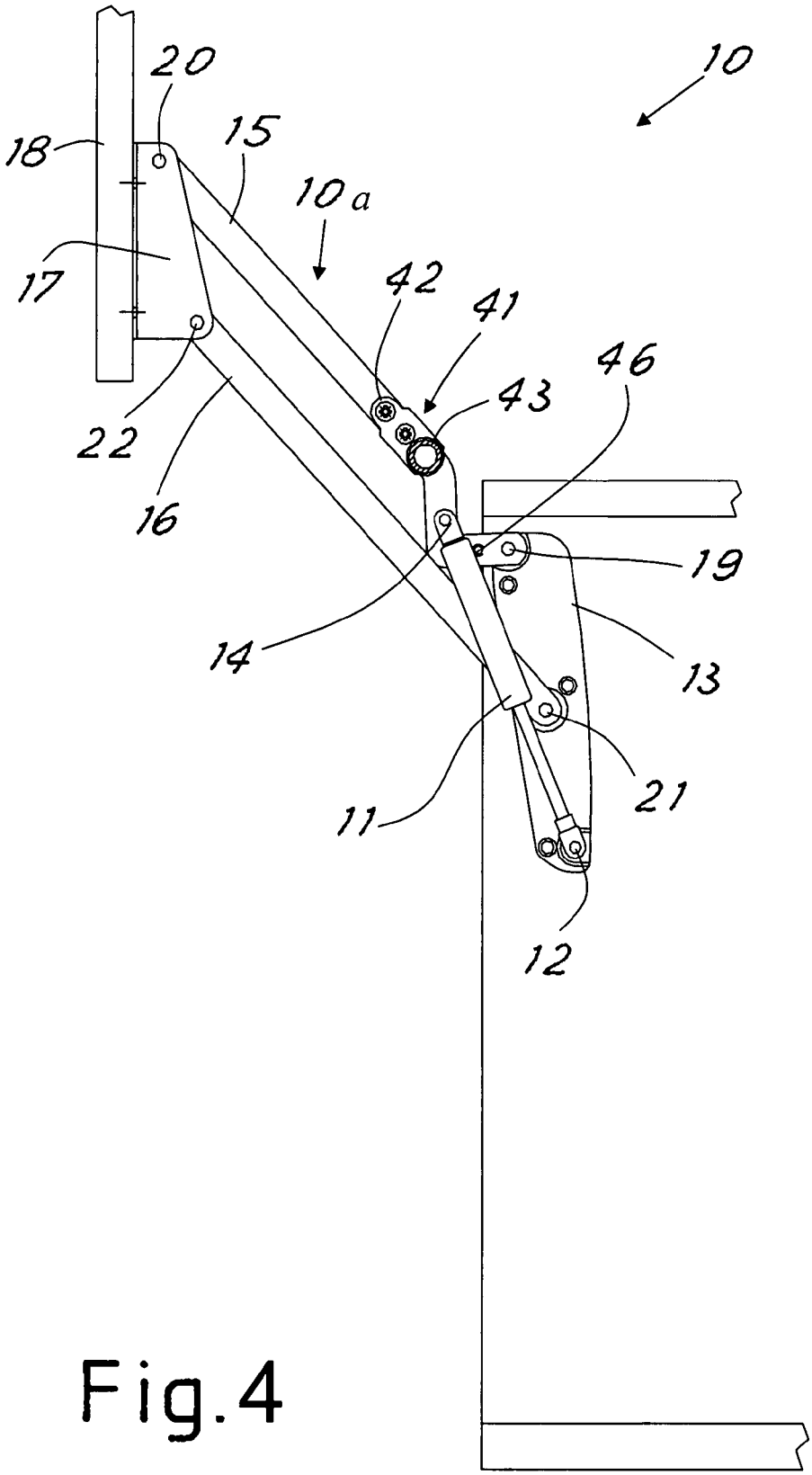
FIG. 4 is a diagrammatic view of the hinge assembly in accordance with the invention, in an open position and in a second operating condition.

The second fastening seat of the bar on arm 15, on the contrary, is farther from pin 19, so that (when the bar is fastened in the second seat) on opening of the door the bar rotates around pin 19 and moves out of the hollow-space opening, so as to make it fully clear. This is clearly shown in FIG. 4. Obviously, in this mounting condition bar 43 stays in a more centered position in the hollow space when the hinge assembly is in the closed position.

In the embodiment shown in the figures, particularly advantageous appeared to be the arrangement of the second seat 41 on the stretch of the upper arm 15 included between the pivot point 14 of spring 11 on arm 15 and the pivot point 20 of arm 15 on the second plate 20. The position is preferably selected so that the bar is just above the opening of the hollow space (which is clearly shown in FIG. 4).

Figure 5:
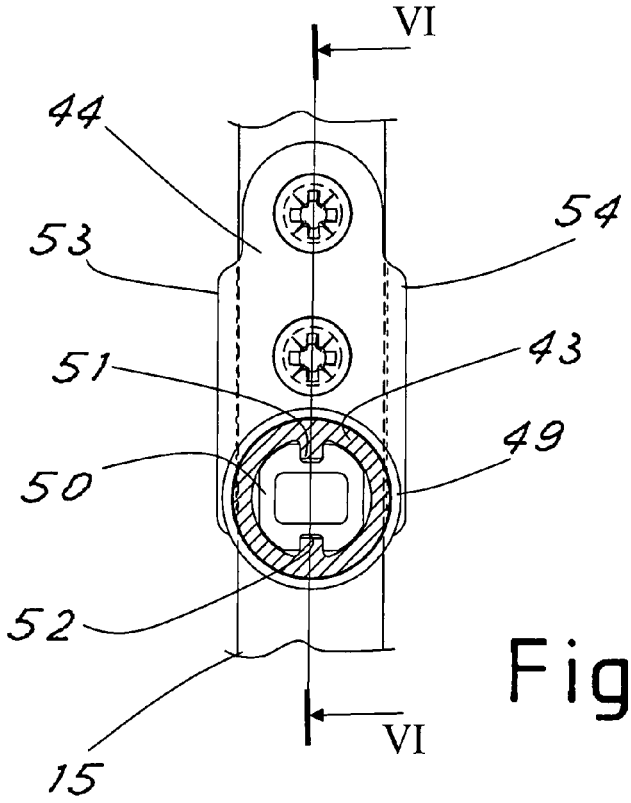
FIG. 5 is an enlarged view of a detail of the hinge assembly in accordance with the invention.
Figure 6:
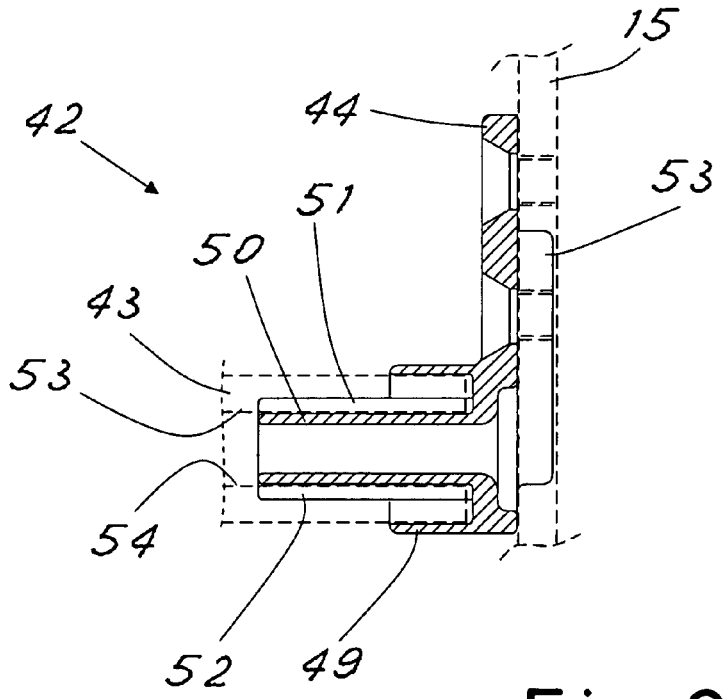
FIG. 6 is a section view taken along line VI-VI in FIG. 5.

An advantageous embodiment of brackets 42 is shown in more detail in FIGS. 5 and 6. This bracket comprises a plate 44, transverse to the axis of bar 43 and pierced with holes at two spaced apart points so as to be screwed down into corresponding holes 45, 46 or 47, 48 present in the mounting seats 40 or 41, respectively (FIG. 1).

Advantageously, projecting from the transverse plate 44 is a tubular sleeve 49 receiving the bar end and surrounding a shank 50 designed to be fitted into the bar of tubular shape. Preferably, a locking coupling preventing mutual axial rotation is present between the shank and tube so as to transmit a torque between the hinges. Coupling can be made axially slidable. This, among other things, enables easier mounting of the hinges.

An easy accomplishment of this coupling is that shown in FIGS. 5 and 6 where the sliding coupling comprises longitudinal grooves 51, 52 in the shank and corresponding longitudinal ribs 53, 54 present on the inner wall of the tubular bar (advantageously made by extrusion).

The tube can be easily cut to size depending on the width of the hollow space and the two brackets can be then easily inserted at the ends, with an end play allowing a less precise length cut.

The sleeve projects in an L-shaped configuration from an end of the plate so that screw fastening is made comfortable, while at the same time enabling positioning of the bar in coaxial relationship with pin 19.

To limit side clearances, wings 53, 54 project from two opposite edges of plate 11, said wings being disposed on the sides of the upper arm 15 when the bracket is fastened thereto. The arm is received between wings 53, 54 with a small side clearance.

The bracket, sleeve and shank can be of one piece construction, made of metal by die-casting.

At this point it is apparent that the intended purposes are achieved.

Depending on the specific requirement, the hinge assembly can be mounted with the stabilizer bar in one of the two positions so as to easily adapt the operating condition of the assembly. This can be done not only on a first mounting, but also when the piece of furniture is in use. For instance, should a non-transparent door be replaced by a transparent door the bar can be moved from the advanced position to the less visible position close to the pin of the upper arm, in this case giving up full accessibility to the hollow space. Obviously, the above description of an embodiment applying the innovative principles of the present invention is given by way of example only and therefore must not be considered as a limitation of the scope of the patent rights herein claimed. For instance, while the possibility of telescopic movement between brackets and bar is advantageous, the brackets can also be fixed or can be secured to the bar ends.

What is claimed is:

1. A hinge assembly for vertical-movement doors, comprising two articulated-quadrilateral hinges each including a first plate designed to be fastened to the furniture flanks, a second plate designed to be fastened to the door and two superposed arms pivotally mounted between the plates, a horizontal bar for synchronization of the hinge movement being transversely connected between the two hinges, characterized in that the hinge assembly comprises brackets for removable fastening of the bar ends to the respective hinges, where the brackets can be alternatively mounted at two different fastening seats present at locations spaced apart from each other, along the upper arm of the superposed arms of each hinge.

2. A hinge assembly as claimed in claim 1, characterized in that one of the fastening seats is placed close to the pivot point of the upper arm on the first plate, in order to have the bar positioned with its axis substantially coincident with the axis of this pivot point.

3. A hinge assembly as claimed in claim 1, characterized in that the hinges comprise a movement-balancing spring pivotally connected between the first plate and the upper arm.

4. A hinge assembly as claimed in claim 3, characterized in that one of the fastening seats is in the stretch of the upper arm included between the pivot point of the spring on the arm and the pivot point of the arm on the second plate.

5. A hinge assembly as claimed in claim 3, characterized in that the spring is connected to the upper arm at an intermediate position between the pivot points of the upper arm to the plates and is connected to the first plate at a point below the pivot point of the lower arm on the first plate.

6. A hinge assembly as claimed in claim 5, characterized in that the pivot point of the spring on the upper arm is offset towards the lower arm relative to the line joining the pivot points of the upper arm to the two plates.

7. A hinge assembly as claimed in claim 1, characterized in that each of the brackets comprises a plate transverse to the bar axis, which plate is pierced with holes at two points to be screwed down into corresponding holes present in the two seats in the upper arm.

8. A hinge assembly as claimed in claim 7, characterized in that a tubular sleeve for receiving the bar end projects from the transverse plate.

9. A hinge assembly as claimed in claim 8, characterized in that the sleeve surrounds a shank that is designed to be fitted into the bar of tubular shape.

10. A hinge assembly as claimed in claim 8, characterized in that the sleeve projects in an L-shaped configuration from one end of the plate of the bracket.

11. A hinge assembly as claimed in claim 7, characterized in that a locking coupling preventing mutual axial rotation is present between the brackets and the bar.

12. A hinge assembly as claimed in claim 11, characterized in that the coupling is axially slidable and comprises longitudinal grooves in a shank projecting from the bracket, which grooves receive corresponding longitudinal ribs present on the inner wall of the bar of tubular shape.

13. A hinge assembly as claimed in claim 7, characterized in that wings project from two opposite edges of the bracket, which wings are disposed on the sides of the upper arm, when the bracket is fastened thereto, in order to receive said arm with a small side clearance.

* * * * *